US005335455A

United States Patent [19]

Bergner

[11] Patent Number: 5,335,455

[45] Date of Patent: Aug. 9, 1994

[54] OSCILLATING GRINDER

[75] Inventor: Joao Bergner, Leonberg, Fed. Rep. of Germany

[73] Assignee: Robert Bosch GmbH, Stuttgart, Fed. Rep. of Germany

[21] Appl. No.: 58,497

[22] Filed: May 5, 1993

[30] Foreign Application Priority Data

Jun. 26, 1992 [DE] Fed. Rep. of Germany ..... 4221029

[51] Int. Cl.[5] ..... B24B 23/00

[52] U.S. Cl. ..... 51/170 MT; 51/170 TL

[58] Field of Search ..... 51/170 MT, 170 R, 170 TL, 51/175

[56] References Cited

U.S. PATENT DOCUMENTS 4,686,797 8/1987 Hoffman ..... 51/170 TL

FOREIGN PATENT DOCUMENTS 2048649 6/1972 Fed. Rep. of Germany .

*Primary Examiner*—Roscoe V. Parker

*Attorney, Agent, or Firm*—Michael J. Striker

[57] ABSTRACT

The oscillating grinder includes a housing; a drive motor having a rotatably driven armature shaft and mounted in the housing; a grinder plate connected with the housing by one or more supporting members each having a long side; an eccentric element mounted eccentrically on the armature shaft for converting a rotary motion of the motor into a linear motion of the grinder plate; and a transmission element having a long side and connecting the eccentric element to the grinder plate. The transmission element and the supporting members have different angular moments of inertia in different directions so that a displacement of the eccentric element in one direction, advantageously in the handle direction, is completely transmitted to the grinder plate, but a displacement in another direction transverse to the first direction is no more than incompletely, and preferably not at all, transmitted to the grinder plate, thus providing a linear grinding motion.

11 Claims, 5 Drawing Sheets

OSCILLATING GRINDER

BACKGROUND OF THE INVENTION

The invention relates to an oscillating grinder or grinding machine.

An oscillating grinder is known, comprising a motor mounted in a housing, and an eccentric device for converting the rotary motion of the motor into a rotating or substantially linear motion of a grinder plate, which is coupled by at least one resilient supporting means with the housing.

This kind of oscillating grinder is known from and described in German Published Patent Application 20 48 649. This oscillating grinder is provided with a special mechanism containing substantially adjustable balancing masses, which converts the circular motion of the drive into a nearly linear oscillation motion of the grinder plate. This mechanism includes many components, is comparatively complicated and makes the oscillating grinder heavier, larger and more expensive in comparison to the oscillating grinder having a nonlinear grinder plate motion. Other known oscillating grinders operate with a more or less damped circular motion of the grinder plate, so that a nearly linear oscillating motion of the grinder plate occurs, in which however circular motion components are not completely suppressed.

The disadvantage of the above-type of grinder with a grinder plate motion that includes some circular motion components is that the grinding is not continuous or precise along edges of and in the vicinity of corners of the workpiece, because the grinder plate is pushed away from the edges by action of the components of the grinder plate motion running transversely to the edges. There is also the danger that the edges or corners of the workpiece are damaged by contact and vibration of the grinder plate.

SUMMARY OF THE INVENTION

It is an object of the present invention to provide an improved oscillating grinder which does not have the above-described disadvantages.

This object, and others which will be made more apparent hereinafter, is attained in an oscillating grinder comprising a drive motor mounted in a housing for producing a rotary motion, and an eccentric device for converting the rotary motion of the motor into a rotating or substantially linear motion of a grinder plate, which is coupled by at least one resilient supporting means with the housing.

According to the invention, a transmission means is provided comprising a transmission element, advantageously a plate having a long side, connected between the eccentric device and the grinder plate. The transmission means and the at least one supporting means are structured and dimensioned so that displacement of the eccentric element in a first predetermined direction and in another direction opposite to the first predetermined direction is completely transmitted to the grinder plate, but displacement of the eccentric element in a second predetermined direction, advantageously perpendicular to the first predetermined direction, and another direction opposite to the second predetermined direction is not transmitted or only partially transmitted to the grinder plate.

In a preferred embodiment of the invention the transmission element is rigid in the first predetermined direction, but nonrigid in the second predetermined direction so that the displacement is not transmitted in the second predetermined direction.

The transmission element is structured so that the angular moments of inertia of the transmission element transverse to the first predetermined direction are small compared to those in the direction of the first predetermined direction. The at least one supporting means however has angular moments of inertia transverse to the first predetermined direction which are large compared to those in the first predetermined direction.

In another preferred embodiment the transmission element comprises an elastic body with an elongate transverse cross-section and a long side and the transmission element is connected with the grinder plate so that the long side is parallel to the feed direction, i.e. the first predetermined direction. Similarly, the at least one supporting means has an elongate cross-section and a long side and the long side is transverse to the first predetermined direction.

Advantageously the transmission means is shaped like a plate and one to four supporting members are provided connecting the grinder plate and the housing.

In another embodiment the at least one supporting means and the transmission means are each connected to the grinder plate in a hinge-like manner by hinge means. In this embodiment the transmission means and the supporting means are each rigid plates.

In a further embodiment of the invention the at least one supporting means and the transmission means can be adjusted. They are provided with means for rotation about axes normal to the grinder plate, so that they can be oriented at an angle to the first predetermined direction and the grinder plate can thus perform nonlinear motions.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENT

Figure 1:
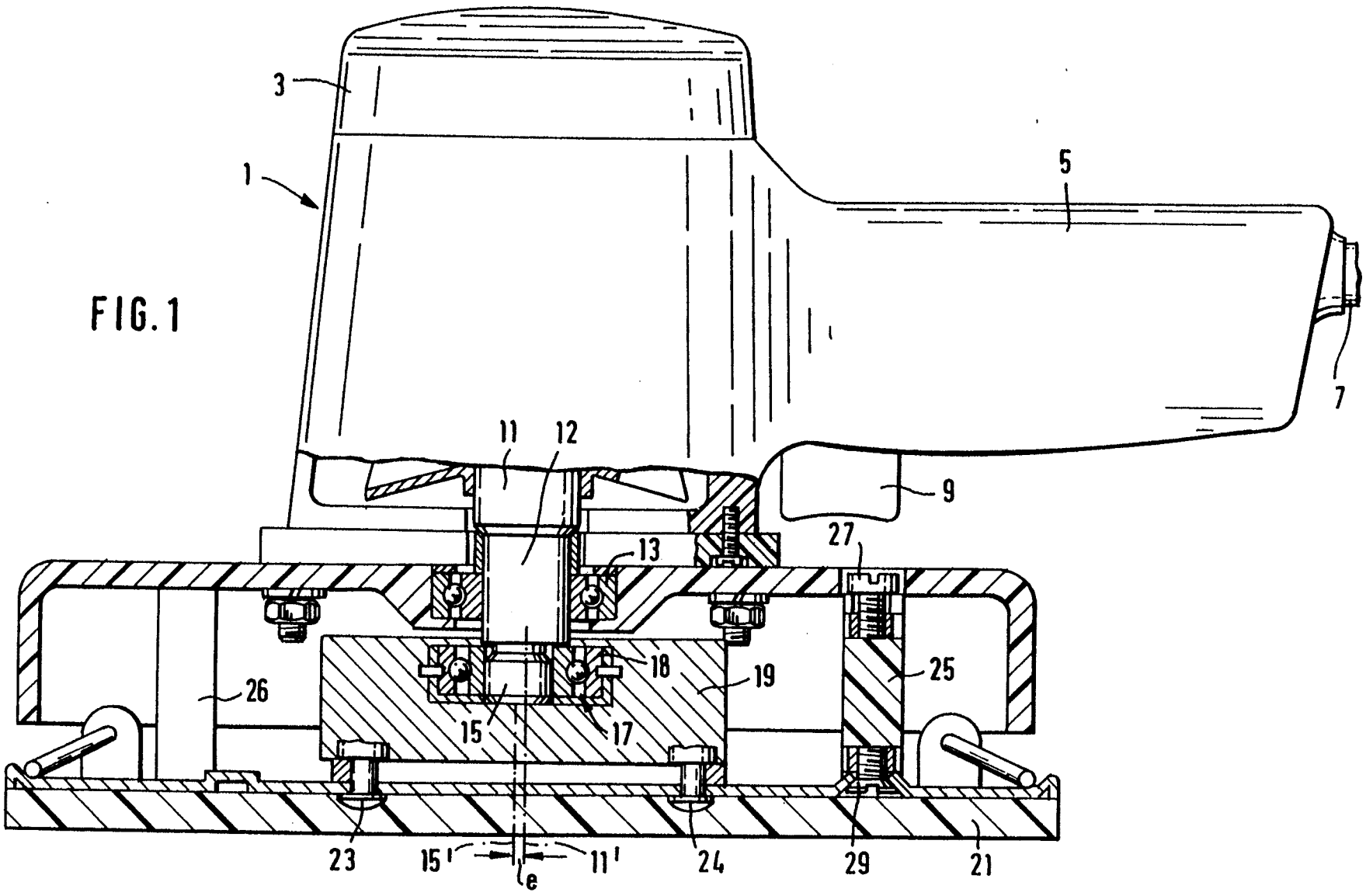
FIG. 1 is a partially side elevational, partially cross-sectional view of a first embodiment of an oscillating grinder according to the invention.

An oscillating grinder 1 according to the invention is shown in FIG. 1. This oscillating grinder 1 has a housing 3 with a handle 5, in which an electrical connecting cable 7 is guided and in which an electrical on/off switch 9 is provided.

An armature shaft 11 of a drive motor is held rotatably with a shoulder 12 in a ball bearing 13 in a lower portion of the housing. The armature shaft 11 has an eccentric element 15 at its lower free end which has a central axis 15', which is displaced by an eccentricity "e" relative to a rotation axis 11' of the armature shaft 11. The eccentric device comprises by definition the eccentric element 15 on shoulder 12 of the armature shaft 11.

The eccentric element 15 is held in another ball bearing 17 in a leaf spring-like transmission element 19. An outer ring 18 of the other ball bearing 17 is rotatably mounted in the transmission element 19 by unshown means about an axis transverse to the armature shaft 11 and/or parallel to the feed motion. The transmission element 19 is attached to a grinder plate 21 by rivets 23,24 and structured to provide motion of the grinder plate along and/or parallel to the handle 5. The transmission element 19 can pivot or swing to and fro in a direction transverse to the X-axis (longitudinal axis) and/or transverse to the handle 5 like a leaf spring.

The grinder plate 21 is attached at its four corners to elastic or resilient supporting members 25,26 connected with the housing 3 by screws 27,29.

Figure 2:
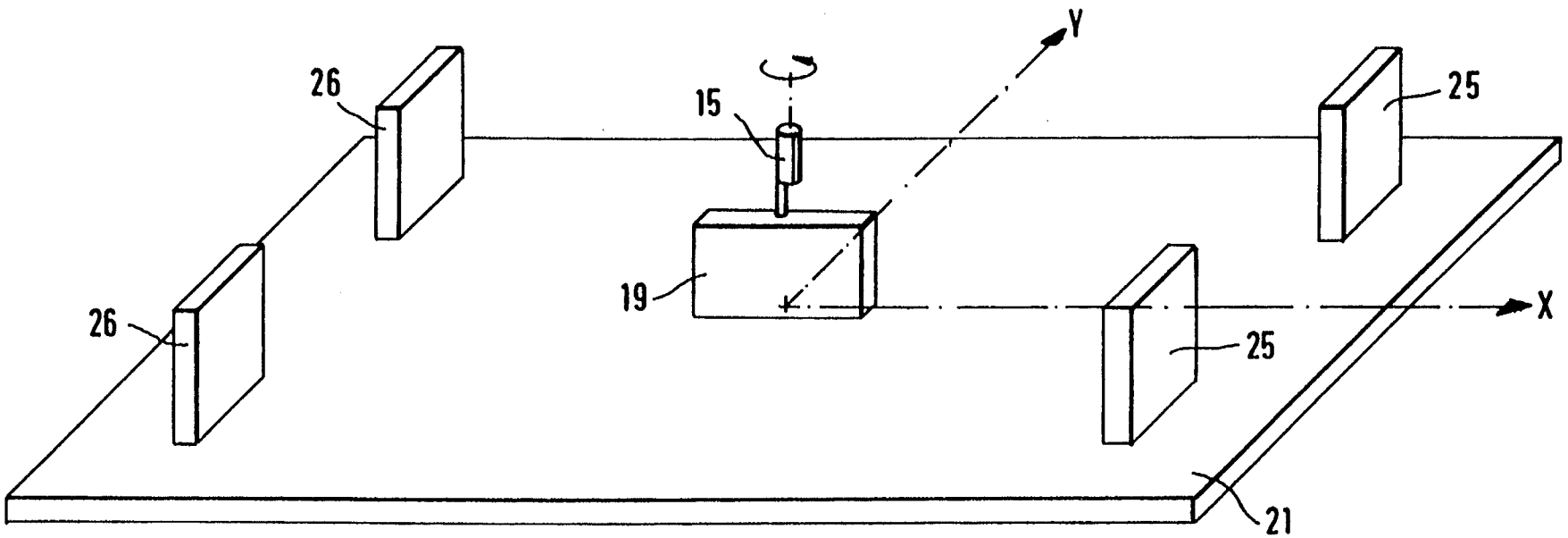
FIG. 2 is a diagrammatic perspective view of an oscillating grinder plate of the apparatus shown in FIG. 1.

The grinder plate 21 of the oscillating grinder of FIG. 1 is shown diagrammatically in FIG. 2 with the supporting members 25,26 and the transmission element 19 with the rectangular cross-section. The transmission element 19 is arranged so that its longitudinal (X) axis runs perpendicular to the longitudinal axes of the columns 25,26 in the plane of the grinder plate 21. The longitudinal axes of the columns 25,26 run parallel to each other.

When the circular motion of the eccentric element 15 is transmitted to the leaf spring-like transmission element 19, the transmission element 19 is structured to follow the displacement of the eccentric element 15 along its longitudinal axis to the extent of the eccentric displacement "e" and the grinder plate 21 is displaced along with it. On the other hand the leaf spring-like transmission element 19 is structured to bend elastically in response to a displacement of the eccentric element 15 transverse to its longitudinal axis and the grinder plate 21 does not follow the eccentric displacement. The elastic supporting columns 25,26 are structured to respond to displacements oppositely to the leaf-spring like transmission element 19. They bend elastically in response to an eccentric displacement along a longitudinal direction of the transmission element 19, but are practically rigid in response to eccentric displacements transverse to the longitudinal axis. Thus, in the embodiment shown, practically no displacement of the grinder plate occurs in a direction transverse to the feed direction and/or to the longitudinal direction of the transmission element 19. The grinder plate 21 cannot pivot substantially laterally so that the grinder plate motion which results is purely to and fro motion in the longitudinal direction of the transmission plate without any circular grinder plate motions.

The transmission element must be structured in all embodiments of the invention so that the rigidity of the transmission element 19 is large in a first predetermined direction, the X direction in FIG. 2, but small in a second predetermined direction, the Y direction in FIG. 2. This means that the elasticity of the transmission element 19 must be large transverse to the first predetermined direction but practically negligible in the first predetermined direction. Similarly, the elastic supporting members 25,26 must be rigid in response to displacements transverse to the longitudinal direction in the embodiment of FIG. 2, but elastic in response to displacements in the longitudinal direction in the embodiment of FIG. 2.

The above directional elasticity is obtained by dimensioning the angular moments of inertia of the transmission element 19 and the elastic supporting members 25,26, large, in either the first or second predetermined direction and in the other direction at right angles, small. This is accomplished in the embodiments shown in the drawing by structuring both the transmission element 19 and the supporting members 25,26 so that they have a rectangular elongate transverse cross-section and they are made from an elastic plastic or rubber material.

Figure 4:
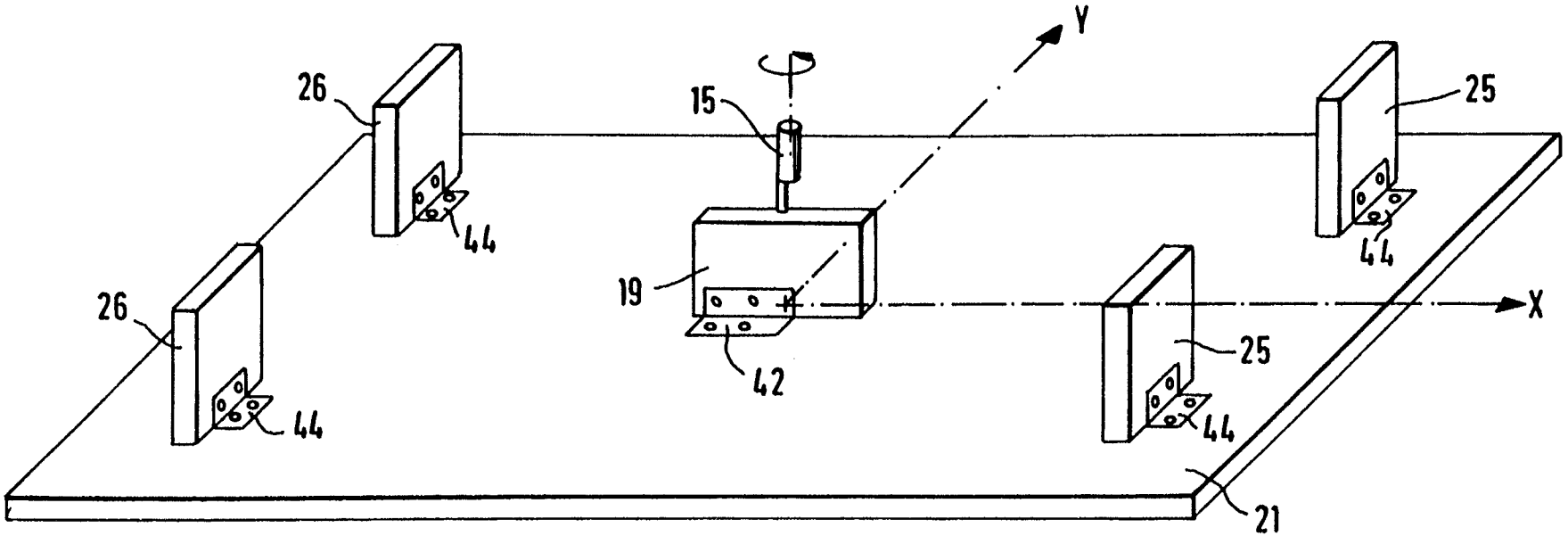
FIG. 4 is a diagrammatic perspective view of a third embodiment of an oscillating grinder according to the invention.

In an embodiment of the invention shown in FIG. 4 the supporting means 25,26 and the transmission element 19 are attached to the grinder plate 21 by respective hinge means 42,44. The supporting means 25,26 and transmission element 19 in this embodiment are rigid parallelepiped bodies. Because of that and the hinge means 42,44 connecting the transmission element 19 and the supporting means with the grinder plate 21 hingedly, the motion of the grinder plate 21 occurs completely in the longitudinal X direction and not at all in the Y direction transverse to the longitudinal direction.

Figure 3:
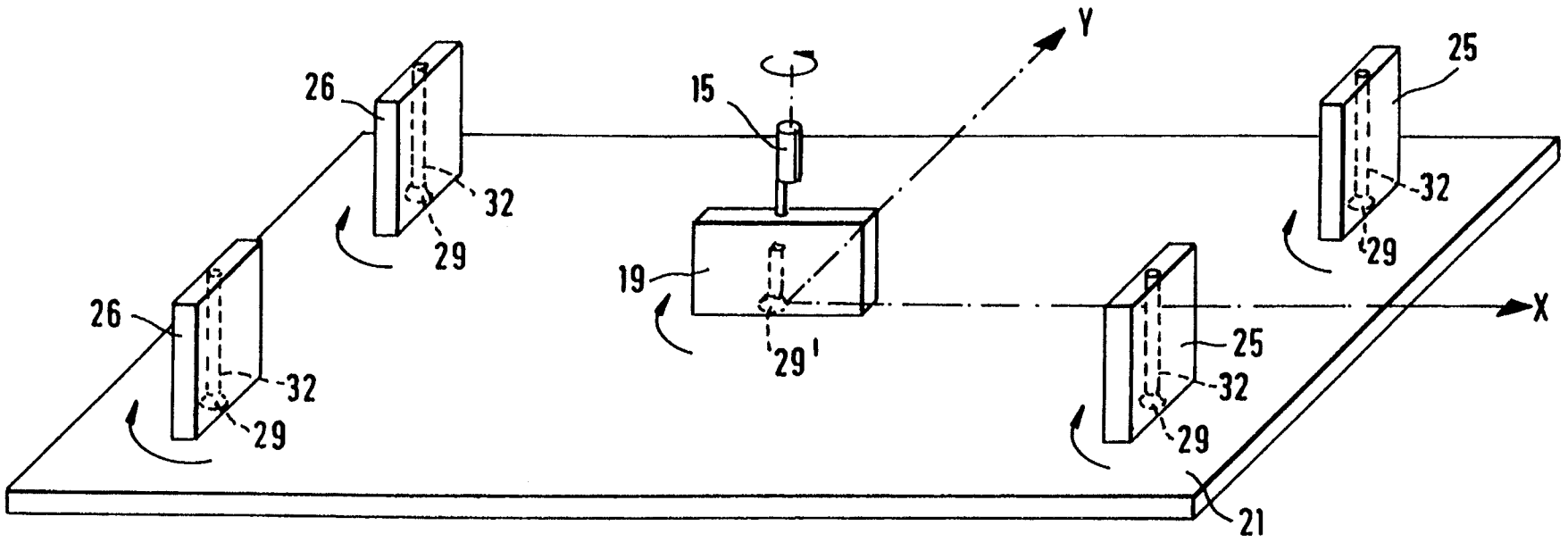
FIG. 3 is a diagrammatic perspective view of a second embodiment of an oscillating grinder according to the invention.

In the embodiment shown in FIG. 3 the elastic supporting members 25,26 and/or the transmission element 19 are adjustable, so that they can be set at an angle to the X or Y axes, i.e. they are rotatable, about an axes normal to the grinder plate 21. As shown in FIG. 3, rotation axles 32 can extend downwardly from the housing 3 and the supporting members 25,26 and the transmission element 19 are pivotally mounted on these rotation axles 32. However the transmission element 19 and the supporting members 25,26 can be fixed by screws 29 passing through the grinder plate 21. To adjust the orientation of the supporting members 25,26 and the transmission element 19 the screws 29 can be loosened, the supporting members and transmission element pivoted to a new orientation and then resecured using the screws 29. Because of that, the grinder plate 21 according to the invention can driven, as necessary, to provide nonlinear grinder motion, for example circular motion, when the supporting members 25,26 and the transmission element 19 are at an angle to the first predetermined direction, i.e. in this embodiment the longitudinal or X axis.

Figure 5:
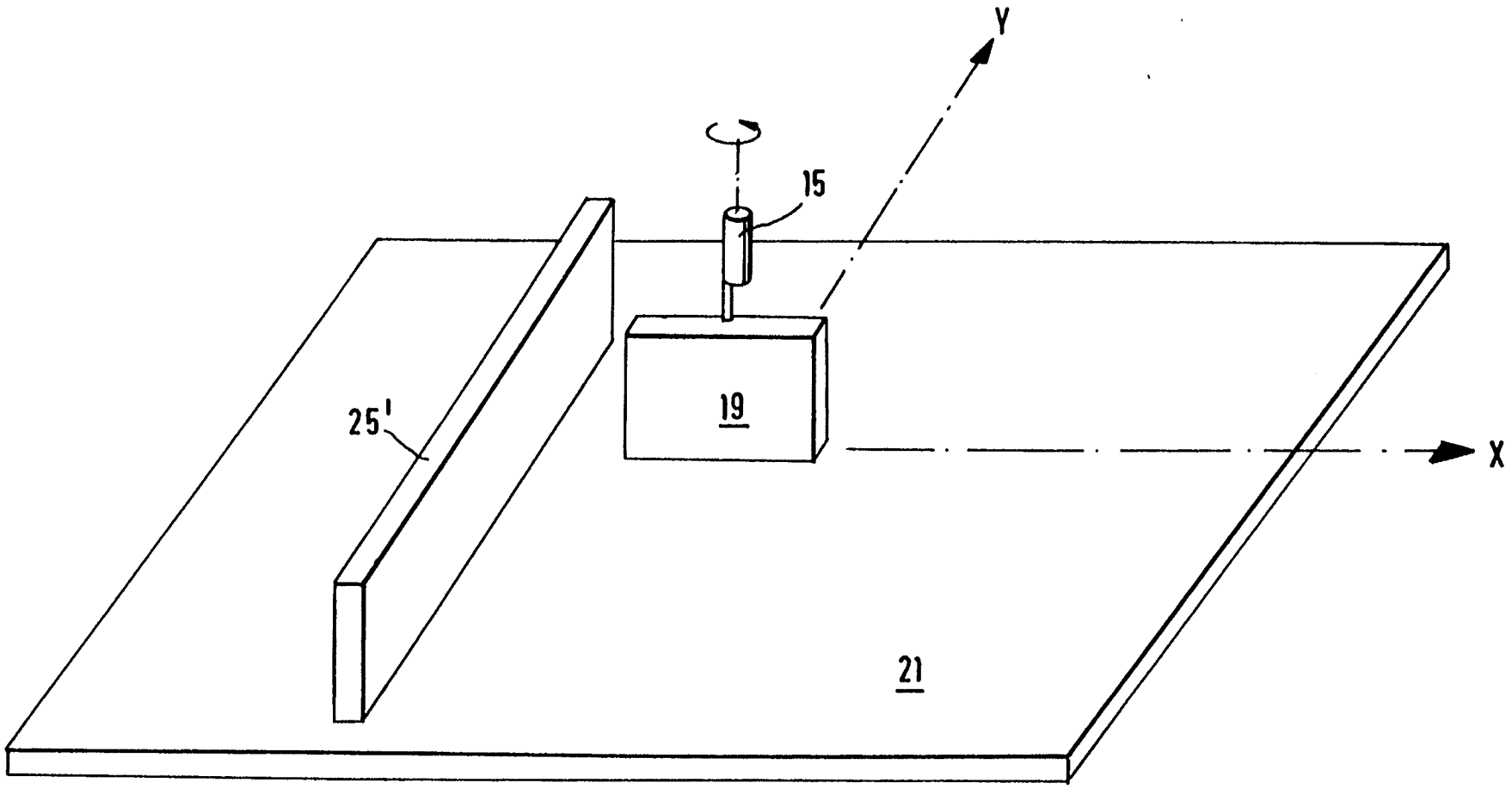
FIG. 5 is a diagrammatic perspective view of a fourth embodiment of an oscillating grinder according to the invention.

In an embodiment shown in FIG. 5 the grinder plate is suspended from the housing only on a single elastic supporting means 25' in the shaped of a parallelepiped element or a plate, because of which the to- and fro-motion of the grinder plate 21 is obtained.

While the invention has been illustrated and embodied in an oscillating grinder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art,fairly constitute essential characteristics of the generic or specific aspects of this invention.

What is claimed is new and desired to be protected by Letters Patent is set forth in the appended claims.

I claim:

1. Oscillating grinder comprising a housing;

a drive motor mounted in the housing and operable to provide a rotary motion;

a grinder plate connected with the housing by at least one elastic supporting means;

an eccentric device connected to the drive motor for converting the rotary motion of the drive motor into a motion of said grinder plate, said eccentric device comprising an eccentric element driven rotatably by the drive motor; and transmission means comprising a transmission element connected between the eccentric element and the grinder plate, wherein said transmission element has angular moments of inertia transverse to a first predetermined direction and angular moments of inertia in said first predetermined direction, said angular moments of inertia of said transmission element transverse to said first predetermined direction are small compared to said angular moments of inertia of said transmission element in said first predetermined direction; and said at least one supporting means has angular moments of inertia transverse to a first predetermined direction and angular moments of inertia in said first predetermined direction, and said angular moments of inertia of said at least one supporting element transverse to said first predetermined direction are large compared to said angular moments of inertia of said at least one supporting element in said first predetermined direction, so that a displacement of said eccentric element in said first predetermined direction is completely transmitted to said grinder plate, but a displacement of said eccentric element in a second predetermined direction transverse to said first predetermined direction is no more than incompletely transmitted to said grinder plate.

2. Oscillating grinder as defined in claim 1, wherein said second predetermined direction is perpendicular to said first predetermined direction.

3. Oscillating grinder as defined in claim 1, wherein said angular moments of inertia of said transmission element and said at least one supporting means are such that said displacement of said eccentric element in said second predetermined direction is not transmitted to said grinder plate.

4. Oscillating grinder as defined in claim 1, wherein the transmission element comprises an elastic body having a long side, said elastic body being connected with said grinder plate so that said long side is parallel to said first predetermined direction.

5. Oscillating grinder as defined in claim 4, wherein the at least one supporting means has a long side and said long side of said at least one supporting means is transverse to said first predetermined direction.

6. Oscillating grinder as defined in claim 4, wherein the transmission element is shaped like a plate.

7. Oscillating grinder as defined in claim 1, wherein said at least one supporting means and said transmission element are rotatable about an axis normal to said grinder plate so that said at least one supporting means and said transmission element can be oriented at an angle to said first predetermined direction so that said grinder plate can then perform a nonlinear motion.

8. Oscillating grinder as defined in claim 1, further comprising hinge means connecting said at least one supporting means to the grinder plate in a hinge-like manner and another hinge means connecting said transmission element to the grinder plate in a hinge-like manner.

9. Oscillating grinder as defined in claim 8, wherein said at least one supporting means comprises a rigid plate and said transmission element comprises another rigid plate.

10. Oscillating grinder as defined in claim 1, wherein said housing and said grinder plate are connected by a single one of said at least one supporting means.

11. Oscillating grinder as defined in claim 10, wherein said single supporting means comprises a plate.

* * * * *